US007637208B2

(12) United States Patent
Reiche et al.

(10) Patent No.: US 7,637,208 B2
(45) Date of Patent: Dec. 29, 2009

(54) APPARATUS FOR STRAPPING ARTICLES AND PROFILE STRIP, IN PARTICULAR FOR COVERING THE BAND CHANNEL OF THE ARTICLE-STRAPPING APPARATUS

(75) Inventors: Udo Reiche, Bornheim (DE); Dieter Kopitz, Leverkusen (DE)

(73) Assignees: Cyklop GmbH, Cologne (DE); Maschinenfabrik Gerd Mosca AG, Waldbrunn (DE)

( * ) Notice: Subject to any disclaimer, the term of this patent is extended or adjusted under 35 U.S.C. 154(b) by 23 days.

(21) Appl. No.: 11/992,157

(22) PCT Filed: Sep. 8, 2006

(86) PCT No.: PCT/EP2006/008779

§ 371 (c)(1),
(2), (4) Date: May 13, 2008

(87) PCT Pub. No.: WO2007/033775

PCT Pub. Date: Mar. 29, 2007

(65) Prior Publication Data

US 2009/0266247 A1 Oct. 29, 2009

(30) Foreign Application Priority Data

Sep. 20, 2005 (DE) ..... 20 2005 014 864 U

(51) Int. Cl.
*B65B 13/04* (2006.01)

(52) U.S. Cl. ..... 100/26; 53/589

(58) Field of Classification Search ..... 100/25, 100/26; 53/589

See application file for complete search history.

(56) References Cited

U.S. PATENT DOCUMENTS

| | | | | |
|---|---|---|---|---|
| 3,613,557 | A * | 10/1971 | Coleman | 100/26 |
| 6,499,525 | B1 * | 12/2002 | Lai | 156/580 |
| 2003/0006012 | A1 | 1/2003 | Lai | |

FOREIGN PATENT DOCUMENTS

| | | |
|---|---|---|
| DE | 32 03 080 | 8/1983 |
| DE | 38 14 029 | 11/1988 |
| DE | 199 12 940 | 9/2000 |
| WO | WO 0056606 A1 * | 9/2000 |

OTHER PUBLICATIONS

Translation of International Search Report (for Int'l Appln. No. PCT/EP2006/008779).
International Search Report for PCT/EP2006/008779.

* cited by examiner

*Primary Examiner*—Jimmy T Nguyen
(74) *Attorney, Agent, or Firm*—Fay Sharpe LLP

(57) ABSTRACT

Apparatus for strapping articles, wherein the band channel (28) of the band guiding frame (13) is covered by profile strips, which consist of an elastic material, preferably an elastically curing polyurethane elastomer casting mass, into which are embedded wear and/or sliding elements in the form of metal helical spring elements (34), the helical spring axes of which run essentially parallel to the band channel (28), and the coils of which project a little bit from the elastic material into the interior (28) of the band channel and form curved sliding surfaces (35) running essentially transversely to the band channel, so that the strapping band essentially only comes into contact with the metallic sliding surfaces of the spring elements during the exit from the band channel, and thereby does not damage the elastic material of the profile strips.

15 Claims, 3 Drawing Sheets

APPARATUS FOR STRAPPING ARTICLES AND PROFILE STRIP, IN PARTICULAR FOR COVERING THE BAND CHANNEL OF THE ARTICLE-STRAPPING APPARATUS

CROSS REFERENCE TO RELATED APPLICATION

This application claims priority to and the benefit of the filing date of International Application No. PCT/EP2006/008779, filed Sep. 8, 2006, which application claims priority to and the benefit of the filing date of German Application No. 20 2005 014 864.4, filed Sep. 20, 2005.

BACKGROUND OF INVENTION

The invention relates to an apparatus for strapping articles, with a band guiding frame which surrounds the article with a distance, and the band channel of which comprises a cover on the side facing the article, which can be opened over its entire length and which closes automatically, which consists of profile strips of an elastic material which are secured to the band guiding frame and which comprise a side wall and a front wall, which overlaps the side of the band channel facing the article at least partially with a distance from the channel base, wherein the profile strips are secured at the band guiding frame beyond the free edges and the base of the band channel and are provided with wear and/or sliding elements at least in the region of the band contact surfaces formed at the front wall. The invention is further directed to a profile strip, in particular for covering the band channel in the band guiding frame of an article strapping apparatus, wherein the profile strip comprises a side wall and a front wall, which are angled to one another and which are manufactured in one piece of an elastic material with a high fatigue strength under reversed bending, and which is provided with wear and/or sliding elements in the region of the band contact surfaces formed at the front wall.

Strapping apparatuses for articles which are to be surrounded with a metal or particularly a plastic band are known in different embodiments. In addition to so-called hand devices, stationary strapping machines are available, where the strapping band is first injected into the band channel at the band guiding frame surrounding the article to be strapped, and then exits from the band channel on the inner side facing the article during the manufacture of the strapping. The band channel is thereby covered by profile strips which are designed in a flexible manner, and can thereby clear the channel at the inner side facing the article, if a tensile force is exerted on the strapping band lying in the band channel during the lashing around the article.

With the strapping apparatuses used currently, the band channel is covered by angled metal strips having a short length, which are arranged at the two side walls of the band guiding frame in a jointed manner and are held pressed by helical springs in a resting position closing the band guiding channel, whereby they can tilt outwardly against the effect of the helical springs when the strapping band is drawn against the article and is tightened. As the covering profile flaps are in fact mounted in an elastic manner, but are inelastic themselves, they open and close by the tension of the strapping band directed inwardly not gradually but abruptly and along their entire length, whereby the exit of the strapping band from the band channel takes place in an irregular manner and with a large noise emission. As the spring tension at the mountings of the individual flaps can hardly be adjusted in an even manner, the covering flaps develop different clamping forces along the band guiding frame and let the strapping band leave the channel at different locations of the band guiding frame which cannot be determined beforehand during the band tensioning procedure. It is also often a problem that the side and face walls of the metal flaps are not in alignment at their abutting surfaces, but that stepped transitions are generated there, with which the strapping band, which is injected into the band channel, can abut with its front transverse edge, which results in failures.

For avoiding the above-mentioned disadvantages with the strapping apparatuses used up to now, it has been suggested in the generic DE 199 12 940 A1, to replace the covering flaps consisting of metal strips with a profile strip of an elastic material, which can cover the band channel at its inner side in respectively one piece, so that abutting surfaces are no longer present in the cover. As the profile strip itself is elastic, it respectively opens the band channel only immediately in the region in which the band has to leave the band channel during its tightening around the article, and closes it again immediately behind it.

The practical implementation of this basically excellent suggestion known from DE 199 12 940 has proved to be more difficult than expected. The strapping band which is drawn radially inwardly from the band channel during the strapping procedure, effected a high wear of the profile strips at the wall contact surfaces formed at their front faces, so that even reasonably acceptable service lives of the profile strip could not be achieved without wear and/or sliding elements provided there, which consist of a particularly wear-resistant material. The wear and sliding elements of polytetrafluoroethylene (PTFE) or a coploymer therefor suggested by DE 199 12 940, which were to be produced with the remainder of the profile strip, had the disadvantage to reduce the flexibility of the profile strip considerably, so that a prompt closure of the band channel after the exit of the strapping band could not be achieved with this.

STATEMENT OF INVENTION

In accordance with the present invention, provided is a apparatus for strapping articles including a strap band guiding frame arranged to surround an article to be strapped and a band channel on an article-facing side of the strap band guiding frame, the band channel having a cover, which can be opened and which closes automatically and has profile strips of elastic material which are secured to the strap band guiding frame. These profile strips including a side wall, via which the profile strips are secured to the guiding frame and a front wall, which at least partially overlaps a side of the band channel facing the article which is provided with wear and/or sliding elements at least at a band contact region of the front wall. The wear and/or sliding elements consisting of at least one metal helical spring element embedded in the elastic material, with a helical spring axis running essentially parallel to the band channel and coils projecting slightly from the elastic material of the front wall into the band channel and forming curved sliding surfaces running essentially transversely to the band channel.

It is an object of the invention to create an apparatus for strapping articles and a profile strip of the above-mentioned type which can be used therewith, with which the band channel of the strapping apparatus can be covered essentially without gaps, and which opens evenly in reaction to an inwardly directed tension of the strapping band and closes again reliably and quickly behind the exiting band, wherein the profile strip has a long service life and still reliably fulfils its function, even after many strapping processes.

This object is solved with the apparatus according to the invention in that the wear and/or sliding elements consist of at least one metal helical spring element embedded in the highly elastic material, the helical spring axis of which is essentially parallel to the band channel and the coils of which project a little from the elastic material of the front wall into the interior of the band channel and form curved sliding surfaces running essentially transversely to the band channel.

This embodiment creates a remarkable wear resistance of the profile strip with the help of the embedded metal helical spring element, as the sections of its metallic coils projecting from the elastic material of the front wall, which naturally have a considerably higher wear resistance than the elastic material into which they are embedded, essentially form the only contact surfaces with the strapping band enclosed in the band channel and retracted again radially inwardly from the band guiding frame. Furthermore, the metal helical spring element also increases the ability of the profile strip to return quickly back into its original position after the exit of the strapping band and to again close the band channel hereby, as the spring is loaded in the respective opening region during the extraction of the strapping band from the band channel by the resulting deformation of the profile strip, that is, is tensioned, and tends to take up its original position as soon as possible, whereby it naturally also takes the front wall of the profile strip into which it is embedded into its closed position. An elastic material which itself does not comprise such high reset properties that a reclosure of the band channel would be ensured immediately after the exit of the strapping band, can thereby be used with the invention, for example if this is desirable due to the other material properties such as wear resistance and the like, as the reset force necessary for the fast reclosure of the channel is ensured by the helical spring element.

The metal helical spring element can be a compression or an extension spring and preferably consists of steel. It is conveniently located at the free edge of the front wall, as the load exerted by the strapping band to the profile strip is highest there. A particularly advantageous embodiment results if several metal helical spring elements are arranged parallel adjacent to one another in the band contact surfaces formed at the front wall.

It is particularly advantageous if the elastic material consists of an elastomer casting mass curing to the elastic profile strip and if the metal helical spring element is cast into the profile strip, whereby a very close connection between the metal of the spring element and the receiving elastic profile strip is achieved. Polyurethane elastomer based on NDI has been proven particularly suitable for the elastomer casting mass. Such a polyurethane elastomer distinguishes itself by a very high dynamic load-bearing capability, high wear resistance and high further tear resistance, can be used in a wide range of temperatures from −40° C. to +80° C., and is also stable with regard to mineral oils and fats, petrol and ozone.

The profile strip according to the invention is thus distinguished preferably in that it consists of an elastically curing elastomer casting mass and that the wear or sliding elements consist of at least one metal helical spring element, which is cast into the profile strip in such a manner that its coils project a little from the cured elastic casting mass at the front wall. The arrangement is thereby conveniently in such a manner that the individual coils of the metal helical spring element have a distance from one another so that they form a plurality of curved sliding surfaces running transversely to the band channel, between which a space forms respectively. The distance of the individual coils from one another can at least correspond to the wire diameter of the spring element, whereby also result spaces between the individual parallel sliding surfaces, the width of which is at least as large as the diameter of the spring wire of which the metal helical spring element consists.

The metal helical spring element can be a steel compression or extension spring, wherein the metal helical spring element preferably consists of a spring wire comprising a particularly smooth, especially a polished surface. By this, an especially low friction coefficient is ensured between the spring element and the strapping band which is in sliding contact with the coils of the spring element during the strapping band.

BRIEF DESCRIPTION OF DRAWINGS

Further characteristics and advantages of the invention result from the following description and the drawing, where a preferred embodiment of the invention is shown with an example. It shows.

DESCRIPTION OF PREFERRED EMBODIMENTS

Figure 1:
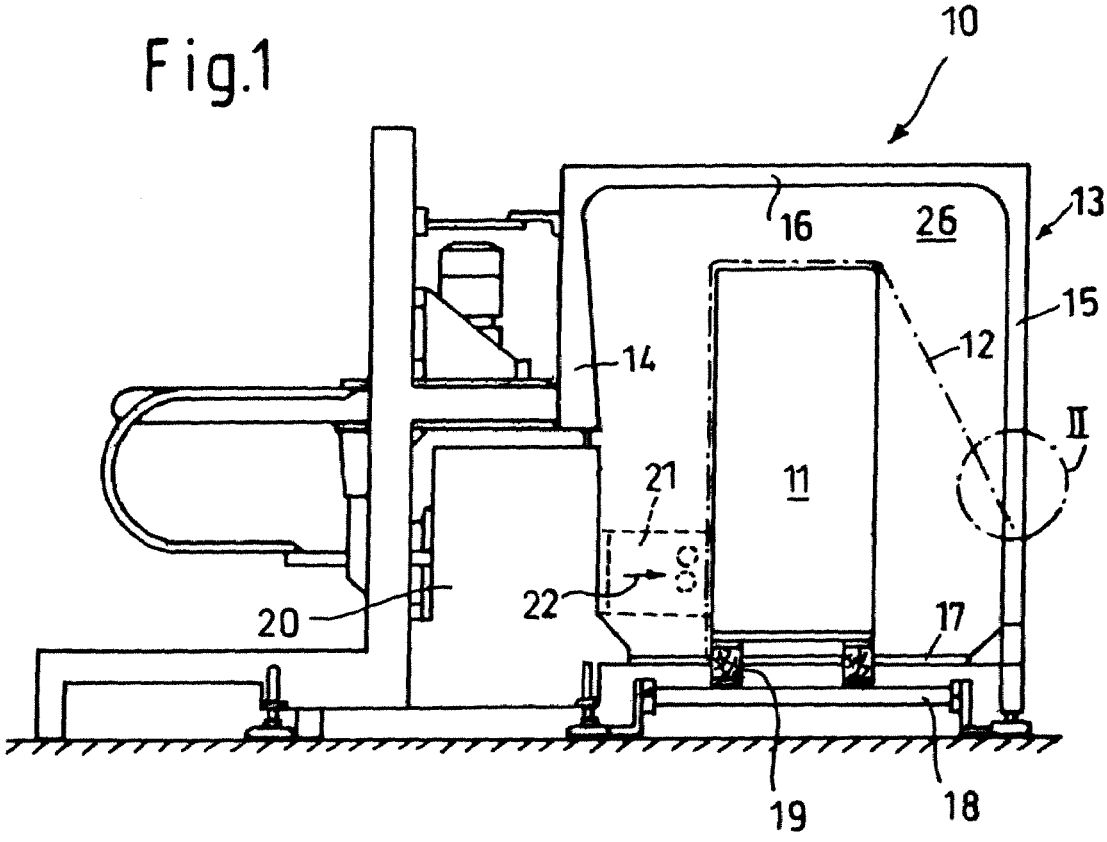
FIG. 1 a strapping apparatus according to the invention in a side view.

The strapping apparatus designated as 10 in its entirety in the drawing serves for strapping an article 11 with a strapping band 12 of plastics. In a manner known per se, the apparatus 10 comprises a band guiding frame 13 which consists of two vertical posts 14 and 15, an upper bar 16 and a band guiding tongue 17. Below the band guiding frame 13 is situated a roll conveyor 18, onto which the article 11 resting on a double palette base 19 can be guided into the strapping plane, which is mounted by the band guiding frame 13.

A machine housing 20 is arranged laterally next to the band guiding frame 13 with a strapping assembly 21, which can drive from the machine housing against the article 11 in the direction of the arrow 22, and with which the strapping band 12 is injected, tightened, closed and cut.

For producing a strapping, the band guiding tongue 17 is advanced from the machine housing 20 through the palette base 19 to the vertical post 15, and the strapping band 12 is guided around the article 11 from the machine housing 20 in the band guiding frame 13 through the band guiding tongue 17, the post 15, the upper bar 16, and the post 14, and is clamped in the strapping assembly 21. The strapping assembly 21 then drives against the article 11 with the clamped band end in the direction of the arrow 22, and draws the strapping band from the band channel into the interior 26 of the band guiding frame 13 during the subsequent tensioning, so that the strapping band 12 abuts to the article. After the complete tensioning and cutting of the strapping band 12, the band guiding tongue 17 is withdrawn and the palette can drive out from the strapping station 10 with the strapped article 11 on the roll conveyor 18.

The posts 14 and 15, the upper bar 16 and the band guiding tongue 17 have band guiding strips 23 which are secured on carrier strips 25 and which comprise a rectangular recess 27 open towards the interior of the band guiding frame on the sides facing the interior 26 of the band guiding frame 13, which recess forms the band channel 28. This band channel is covered by the front walls 28 by two profile strips 30 on its side facing the article 11, which strips are secured to the side surfaces 31 of the band guiding strips 23 and 24 of the band guiding frame 13.

Figure 4:
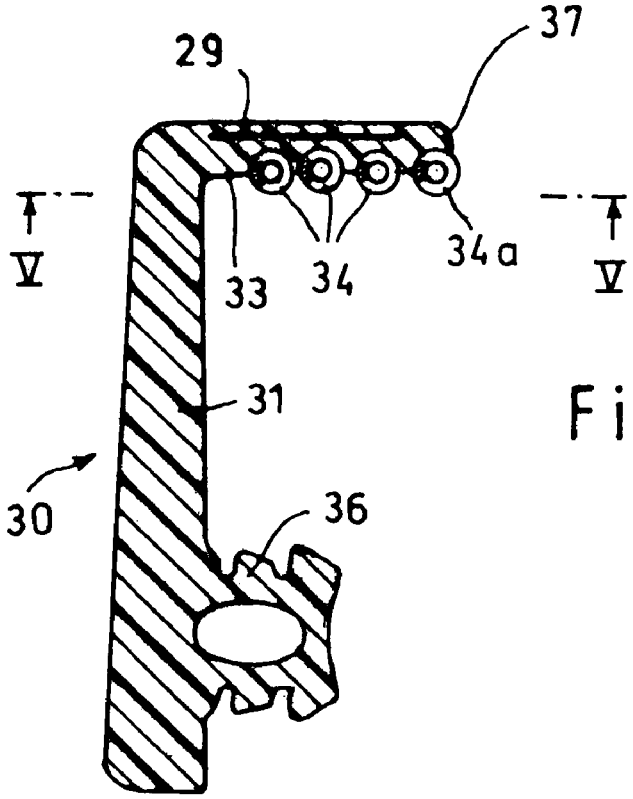
FIG. 4 a cross section through a profile strip covering the band channel in an enlarged scale.
Figure 5:
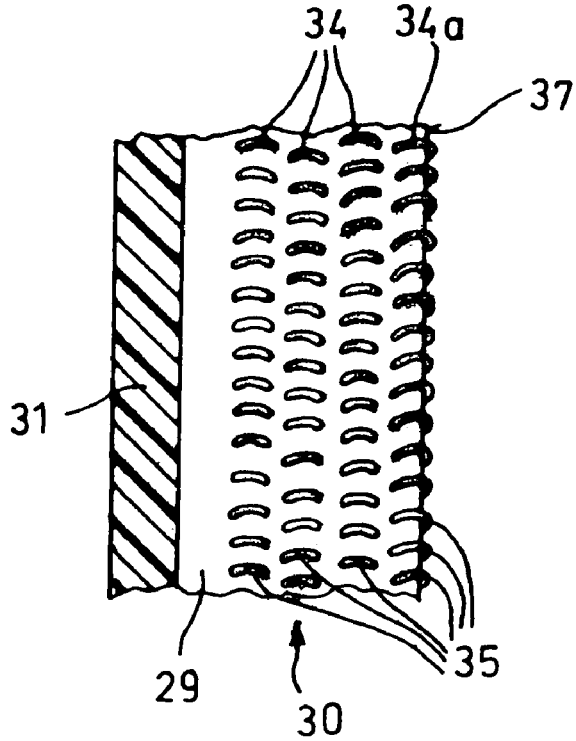
FIG. 5 the object of FIG. 4 in the partial section of line V-V.

As far as described up to now, the strapping apparatus according to the invention corresponds to the one illustrated and described in the older DE 19912 940 A1, the disclosure content of which is expressly referred to here for further explanation of the functioning of these strapping apparatuses. The apparatus according to the invention distinguishes itself from the previously known machine essentially in the design of the profile strips used therein, which are illustrated in more detail in FIGS. 3 to 5.

The profile strips 30 comprise a side wall 32 and a front wall 29 firmly connected thereto, which are arranged to one another with an approximate right angle. The side and front walls of the profile strip made in one piece consist of an elastically curing elastomer casting mass, namely a polyurethane elastomer on the basis of NDI. At the inner side 33 of the front wall, with every profile strip, are arranged four wear and sliding elements in the form of metal helical springs 34 running adjacent to one another in the longitudinal direction of the band channel, which springs are cast into the profile strip during its manufacture in such a manner that their coils project a little bit from the elastic material of the front wall into the interior 28 of the band channel, so that the coil parts 35 of the springs 34 projecting from the material of the front wall form curved sliding surfaces running essentially transversely to the band channel 28.

The metal helical spring elements 34 are compression of extension springs of steel wire, preferably polished steel wire which has a particularly smooth surface, and along which the strapping band can slide with very little resistance without being damaged. As the coils of the springs project a little from the elastic carrier material of the profile strip, it is ensured during the strapping process that the strapping band does not come into contact, or anyway not in noteworthy contact, with the elastic material of the profile strip and wears this out. The metallic curved sliding surfaces of the spring coil parts 35 running transversely to the band channel, which project from the elastic material of the front wall, rather ensure that a contact only takes place between the strapping band and the wear-resistant steel of the helical spring elements.

Figure 2:
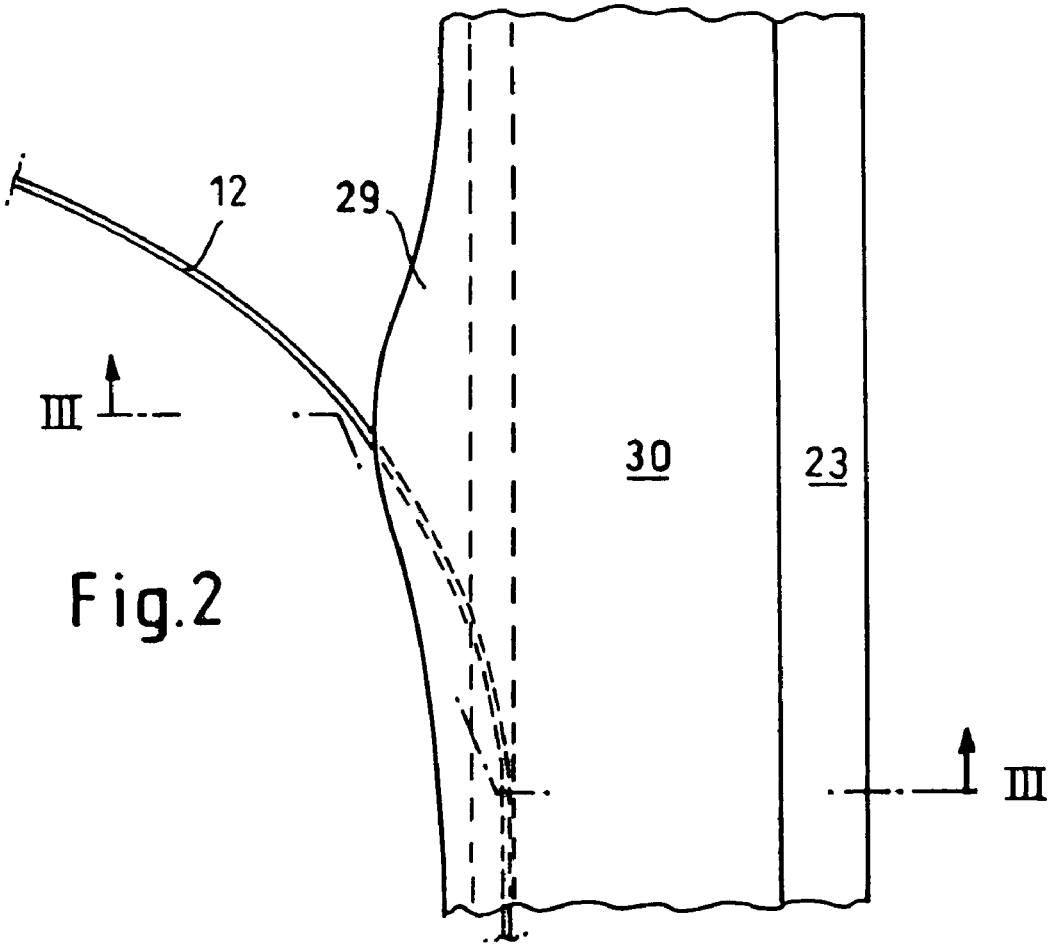
FIG. 2 a detail II of FIG. 1 in an enlarged scale which shows the exit of the strapping band from the band channel.
Figure 3:
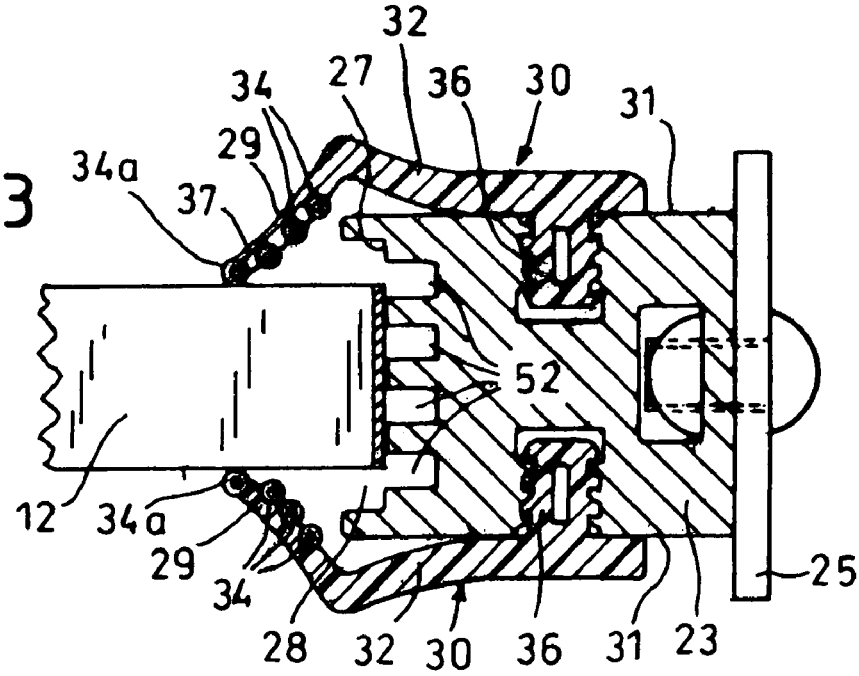
FIG. 3 a partial cross section through the object of FIG. 2.

When the strapping band 12 is drawn from the band channel 28 into the interior 26 of the band guiding frame 13 for strapping the article, as is shown in FIGS. 2 and 3, the profile strips secured to the band guiding strips 23 and 24 by means of clamping strips 36 are bent open a little bit, so that the side walls 32 lift off a little from the band guiding strips 23 and 24 and the front walls 29 of the strapping band are deformed a bit into the interior 26 of the band guiding frame. The metal helical spring elements 34 are thereby also extended and come under the influence of tensile strength, wherein the deformation and accordingly the occurring tension is the largest at the spring element 34*a*, which is present in the immediate vicinity of the free edge 37. The reset forces of the springs resulting from these tensions effect that the profile strips again return to their original position, shown in FIG. 4, immediately after the exit of the strapping band 12 from the band channel 28, in which they close the band channel 28 on the inside. That is, the spring elements cause a type of memory effect at the profile strip, in fact even then, if the elastic material of the profile strip has (partially) lost its elasticity after prolonged use, as the spring effect of the helical spring elements of metal is kept reliably even then.

While considerable emphasis has been placed on the preferred embodiments of the invention illustrated and described herein, it will be appreciated that other embodiments and/or equivalents thereof can be made and that many changes can be made in the preferred embodiments without departing from the principles of the invention. Accordingly, it is to be distinctly understood that the foregoing descriptive matter is to be interpreted merely as illustrative of the invention and not as a limitation.

The invention claimed is:

1. An article strapping apparatus comprising a strap band guiding frame arranged to surround an article to be strapped, and a band channel on an article-facing side of the strap band guiding frame, the band channel comprises:

a cover, which is openable and which is automatically closable, and the cover has profile strips of elastic material which are secured to the strap band guiding frame and each of the profiles strips comprising:

a side wall, via which the profile strip is secured to the guiding frame and a front wall, which at least partially overlaps a side of the band channel facing the article, the front wall is provided with:

wear and sliding elements at least at a band contact region of the front wall, the wear and sliding elements consisting of at least one metal helical spring element embedded in the elastic material, with a helical spring axis of the at least one metal helical spring element running essentially parallel to the band channel and coils projecting slightly from the elastic material of the front wall into the band channel and forming curved sliding surfaces running essentially transversely to a longitudinal axis of the band channel.

2. The apparatus according to claim 1, wherein the metal helical spring element is a compression spring.

3. The apparatus according to claim 1, wherein the metal helical spring element is a tension spring.

4. The apparatus according to claim 1, wherein the metal helical spring element consists of steel.

5. The apparatus according to claim 1, wherein one metal helical spring element is arranged at a free edge of the front wall.

6. The apparatus according to claim 1, wherein a plurality of metal helical spring elements are arranged in the band contact surface of the front wall in a parallel manner.

7. The apparatus according to claim 1, wherein the elastic material consists of a cast elastomer, and the metal helical spring element (34) is cast into the profile strip (30).

8. The apparatus according to claim 7, wherein the elastomer casting mass is a polyurethane elastomer based on NDI.

9. A profile strip in combination with an article strapping apparatus, the profile strip for covering a band channel in a band guiding frame of the article strapping apparatus the profile strip comprises a side wall and a front wall, which are angled to one another and which are made in one piece of an elastic material with a high fatigue strength under reversed bending, the profile strip consisting of an elastically curing elastomer cast mass and being provided with wear and slide elements in the region of band contact surfaces formed at the front wall, the wear and sliding elements consisting of at least one metal helical spring element embedded in the elastic material, the at least one metal helical spring element having a helical spring axis running essentially parallel to the band channel and coils projecting slightly from the elastic material of the front wall into the band channel and forming curved sliding surfaces running essentially transversely to a longitudinal axis of the band channel.

10. The profile strip according to claim 9, wherein the individual coils of the metal helical spring element have a distance from one another.

11. The profile strip according to claim 10, wherein the distance corresponds at least to the wire diameter of the spring element (34).

12. The profile strip according to claim 9, wherein the metal helical spring element is a steel compression spring.

13. The profile strip according to claim 9, wherein the metal helical spring element is a steel tension spring.

14. The profile strip according to claim 9, wherein the metal helical spring consists of a spring wire with a smooth surface.

15. The profile strip according to claim 9, wherein the metal helical spring consists of a spring wire with a polished surface.

* * * * *